United States Patent [19]

Mayer

[11] 4,159,703

[45] Jul. 3, 1979

[54] AIR ASSISTED FUEL ATOMIZER

[75] Inventor: Endre A. Mayer, Birmingham, Mich.

[73] Assignee: The Bendix Corporation, Southfield, Mich.

[21] Appl. No.: 748,864

[22] Filed: Dec. 10, 1976

[51] Int. Cl.[2] ..... F02M 69/00; F02D 3/00; F02D 3/02; F02M 69/04

[52] U.S. Cl. ..... 123/139 AW; 123/34 R; 123/35; 123/119 R

[58] Field of Search ..... 123/35, 34 R, 139 AW, 123/119 R

[56] References Cited

U.S. PATENT DOCUMENTS

| | | | |
|---|---|---|---|
| 2,860,616 | 11/1958 | Dermond | 123/139 AW |
| 2,860,617 | 11/1958 | Pringham | 123/139 AW |
| 2,864,354 | 12/1958 | Bartz | 123/139 AW X |
| 2,893,370 | 7/1959 | Winkler | 123/139 AW X |
| 2,902,016 | 9/1959 | Powell et al. | 123/139 AW |
| 3,182,646 | 5/1965 | Kuechenmeister | 123/139 AW |
| 3,288,445 | 11/1966 | Mennesson | 123/139 AW X |
| 3,498,274 | 3/1970 | Chapman | 123/119 A |
| 3,608,531 | 9/1971 | Baxendale | 123/35 |
| 3,931,814 | 1/1976 | Rivere | 123/139 AW |

FOREIGN PATENT DOCUMENTS

| | | | |
|---|---|---|---|
| 2529769 | 2/1976 | Fed. Rep. of Germany | 123/139 AW |
| 1161497 | 8/1969 | United Kingdom | 123/139 AW |
| 1513434 | 6/1978 | United Kingdom | 123/139 AW |

*Primary Examiner*—Wendell E. Burns

*Attorney, Agent, or Firm*—James R. Ignatowski; Russel C. Wells

[57] ABSTRACT

An improved air assisted fuel atomizer is disclosed herein. The atomizer receives air from a source having a higher pressure than the output environment of the atomizer and fuel under pressure from a pulsed source. Each fuel pulse is injected tangentially into a circular fuel swirl chamber to form a rotating fuel ring concentric with air path through the atomizer. Fuel from the rotating fuel ring is gradually carried off by the air flow to produce uniformly distributed effectively continuous air/fuel mixture. In the preferred embodiment the air assisted fuel atomizer is embodied in an internal combustion engine, single point fuel injection system.

25 Claims, 5 Drawing Figures

AIR ASSISTED FUEL ATOMIZER

BACKGROUND OF THE INVENTION

1. Field of the Invention

The field of the invention is related to atomizers and in particular to a fuel atomizer for an electronically controlled single point fuel injection system for an internal combustion engine.

2. Prior Art

Proper atomization of the fuel prior to being burned in an internal combustion engine, furnace, or any other liquid fuel consuming device is considered necessary for obtaining the maximum efficiency of the combustion process. Almost every imaginable mechanism known has been used at one time or another in order to achieve or improve fuel atomization. These range from swirling the fuel as taught by Delaunay-Belleville in U.S. Pat. No. 1,206,978 (December, 1916) and Grundman et al in U.S. Pat. No. 3,477,647 (November, 1969). Alternatively, Betteson in U.S. Pat. No. 2,719,056 (September, 1955); Romann et al in U.S. Pat. No. 3,680,794 (August, 1972) and Boltz et al in U.S. Pat. No. 3,782,639 (January, 1974) teach swirling the air to achieve the same purpose. It is noted that in the Romann and Boltz patents the initial atomization of the fuel is provided by nozzle configuration of a fuel injector valve which is assisted by the swirling air.

Another technique also used is to inject the fuel through a plurality of small orifices as taught by Fush in U.S. Pat. No. 1,081,228 (December, 1913) or Harper in U.S. Pat. No. 2,382,151 (Aug. 14, 1945) and maybe others. Alternately, the fuel may be dispersed using a flanged pintle for dispersing the fuel radially as it is being ejected from a nozzle as taught by Krauss in U.S. Pat. No. 3,613,998 (October, 1971) or Schlagmuller et al in U.S. Pat. No. 3,967,597 (July, 1967). Ray in U.S. Pat. No. 2,557,514 (June, 1951) teaches splashing the injected fuel against a dispersion surface. This surface may be a rigid surface as taught by Ray or may be a surface vibrating at ultrasonic frequencies as taught elsewhere in the art. It is even known to use ultrasonic sound waves themselves to atomize the fuel particles. In general, most of the above discussed methods are capable of atomizing the fuel to a greater or lesser extent and are quite satisfactory when used with a continuous fuel supply. With the advent of modern fuel control systems using computers; electronic, mechanical, hydraulic, or hybreds thereof, it has been found to be more expedient and efficient to compute and supply the engine's fuel requirements on a pulse rather than a continuous flow basis. These fuel pulses are normally produced in synchronization with the opening of the engine's individual intake valves. In a conventional multipoint injection system having one fuel injector valve for each cylinder, each valve opens only once for every two revolutions of the engine; however, in a single point fuel injection system, having only one fuel injector valve, the repetition rate of the single injector valve increases in proportion to the number of engine cylinders. In general the repetition rate of the injector valve in a single point fuel injection system increases by a factor of two to four over the repetition rate of the fuel injectors in a multipoint fuel injection system. Thus, the injector valve life expectancy in terms of vehicle mileage is reduced one-half to one-fourth the life expectancy of the same valve in a multipoint system. Another factor to be considered is the uniformity of the fuel delivery at low engine speeds. The fuel from the single injector valve is delivered at a location remote from the engine's intake ports and due to the compressibility of the air in the intake manifold the air flow at the point of injection is relatively continuous. At low engine speeds the fuel pulses are relatively short with a much longer time between pulses. At idle engine speeds the ratio of periods between injection to injection time may be as high as 10 to 1. Therefore, the intermittently injected fuel results in a stratified nonuniform air fuel mixture being supplied to the engine. At high speeds, the fuel requirements of the engine increase and the injection pulses become much longer and as a consequence the off time between injection pulses becomes inadequate for the proper opening and closing of the injector valve, and the actual fuel delivery is no longer equal to the computed value. This coupled with the decrease in the life expectancy of the injector valve has made the single point injection system unattractive to the automotive industry.

The disclosed invention is an air assisted fuel atomizer for an internal combustion engine single point fuel injection system overcoming the deficiencies of the prior art. The associated fuel control valve may supply fuel on a continuous or pulsed basis and may be either mechanically or hydraulically actuated as well as electrically actuated as shown in the preferred embodiment.

SUMMARY OF THE INVENTION

The invention is an air assisted fuel atomizer directly applicable to an internal combustion engine single point fuel injection system. The atomizer not only produces a fine uniform fuel vapor, but also stretches the time of fuel delivery so that even at low speeds the fuel delivery is effectively continuous significantly improving the fuel air mixture supplied to the engine. The stretching of the fuel delivery also has a significant advantage at high speeds since it eliminates the requirement that fuel be delivered at the same repetition rate as the ignition pulses. Therefore, a single fuel injection pulse may span two or more ignition pulses, significantly reducing the repetition rate of the fuel control valve and increasing the life expectancy of the valve by a factor of two or more.

The air assisted fuel atomizer comprises a housing having an internal air chamber receiving air from the primary air passageway of a throttle, upstream of the throttle valve, controlling the air flow through the throttle, a circular fuel swirl chamber receives the fuel injected by the fuel control valve tangential to its inner surface forming a fuel ring therein, an orifice restricting the air flow through the atomizer, and an exit port returning the vaporized air fuel mixture back to the throttle downstream of the throttle valve.

The object of the invention is an air assisted fuel atomizer for producing uniformly distributed air/fuel mixture for an internal combustion engine.

Another object of the invention is an air assisted fuel atomizer which stretches out the fuel delivery time of a pulsed fuel input to effectively produce a continuous fuel delivery at low engine speeds.

Still another object is an air assisted fuel atomizer which stretches out the fuel delivery time of a pulsed fuel input so that at high speeds a single pulse may span two or more ignition pulses, substantially reducing the repetition of the fuel control valve and increasing its life expectancy in terms of vehicle mileage.

These and other objectives of the invention will become apparent from a reading of the following specification with reference to the drawings.

DETAILED DESCRIPTION OF THE PREFERRED EMBODIMENT

Figure 1:
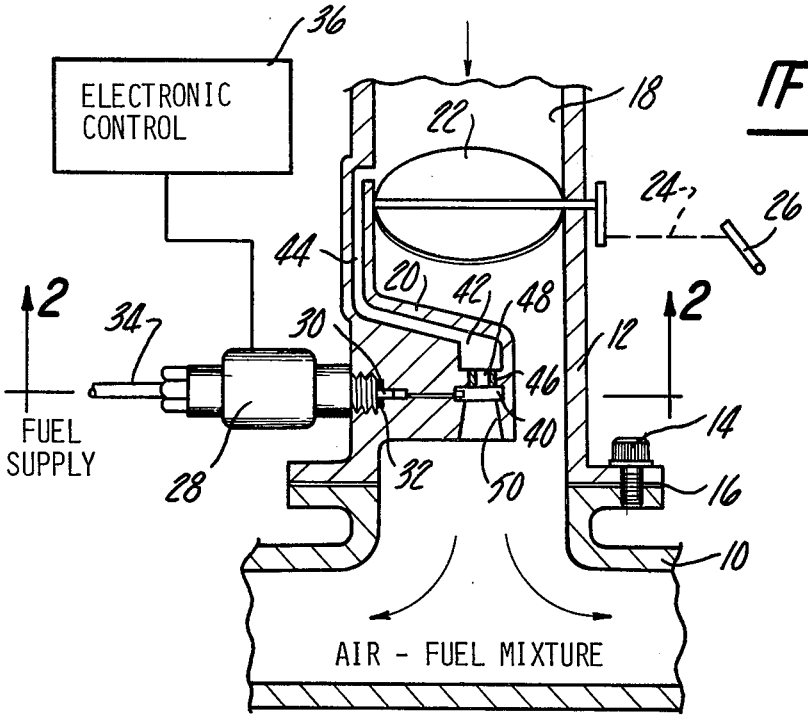
FIG. 1 is a cross sectional view of a throttle assembly embodying the air assisted fuel atomizer.

Referring to FIG. 1 there is shown the intake manifold 10 of an internal combustion engine which distributes an atomized air/fuel mixture to the intke ports of the individual cylinders as is well known in the art. A throttle body 12 is fixedly attached to the manifold 10 by means of one or more fasteners such as bolt 14. A gasket 16 insures a leak-tight seal at the interface between the throttle body 12 and the intake manifold. The throttle body 12 has a generally cylindrical primary air passageway 18 conducting atomspheric air after passing through a filter (not shown) to the intake manifold 10 and an atomizer housing 20 illustrated as an internal boss extending from the wall of the throttle body into the central area of passageway 18. A throttle valve 22 is disposed in the passageway 18 above the atomizer 20 and controls the air flow through the throttle body. The throttle valve 22 is actuated either directly by a mechanical linkage illustrated as dashed line 24 by a throttle actuator illustrated as an operator's foot pedal 26 or indirectly by a servo system as is known in the art.

A fuel control valve 28 having an output port 30 is fixedly attached to the throttle body 12. The fuel control valve 28 may be threaded onto the throttle body as shown or may be attached using any other means. The fuel control valve receives fuel from a pressurized source (not shown) by means of a fuel line 34. The pressurized source may include a fuel tank, a fuel pump, and a pressure regulator system as is conventionally employed on most internal combustion engines.

In the preferred embodiment the fuel control valve is electrically actuated by signals generated by an electronic control unit 36 generating pulse signals having a time duration indicative of the engine's fuel requirements in response to the operating parameter of the engine. The electronic control unit 36 may generate signals indicative of fuel requirement of two or more cylinders as taught by the prior art.

Figure 2:
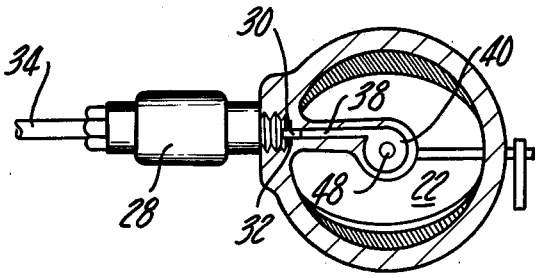
FIG. 2 is a cross sectional view of the throttle assembly and the air assisted fuel atomizer of FIG. 1 in the plane designated 2—2.

The fuel from the fuel control valve is injected into a fuel passageway 38, shown on FIG. 2, connecting the output port 30 of the fuel control valve with fuel swirl chamber illustrated as groove 40 formed in the atomizer housing 20 generally coaxial with the passageway 18. The fuel control valve 28 and fuel passageway 38 are shown out of position in FIG. 1 for illustrative purposes and are actuatlly offset from the axis of groove 40 as shown in FIG. 2. A gasket 32 contains the fuel flow from the output port 30 to the fuel passageway 38, and prevents fuel leakage to the outside of the throttle body through the threaded section. Fuel passageway 38 is offset from the axis of groove 40 and preferentially intercepts the cavity formed by groove 40 tangential to its inner surface. A cylindrical chamber 42 is formed in atomizer housing 20 above groove 40 which is connected to the throttle body passageway 18 at a point upstream the throttle valve 22 by an air passageway 44. Preferentially, air passageway 44 is offset from the axis of chamber 42 so that air entering the chamber from passageway 44 will be caused to swirl. However, the air assisted atomizer will function satisfactorily even if the air enters chamber 42 axially.

An orifice plate 46 having an axial orifice 48 is disposed between the cavity 40 and the groove 40 and controls the air flow from cavity 42. The exit port 50 of the air assisted atomizer is in the form of a truncated cone having its smaller end intercepting groove 40. The diameter of the exit port where it interfaces groove 40 is slightly smaller than the diameter of groove 40 forming a small lip which monetarily retains the tangentially injected fuel in groove 40 so that it becomes evenly distributed about the inner surface of the groove.

The operation of the air assisted fuel atomizer is as follows. The input end of passageway 44 receives air at ambient pressure from a location in the throttle body above throttle valve 22. When the throttle valve 22 is closed and the engine is running, the pressure in the intake manifold 10 is substantially below the air pressure in the throttle body 12 above the closed throttle plate 22. Air flows through passageway 44 through the chamber 42 through the aperture 48 of aperture plate 46 past the groove 40 and into the manifold 10 through the outlet port 50. At engine idle the air flow through may be as high as 80 percent of the engine's idle air flow. When the throttle valve 22 is partially opened or fully opened a lower pressure is still generated at the outlet port 40 of the air assisted fuel atomizer and air continues to flow through passageway 44 as described above, assuring an adequate air flow through the atomizer at all times.

The fuel ejected by the fuel control valve 28 in response to activation by electronic control unit 36 enters the groove 40 at a relatively high velocity and develops a fuel ring within the groove. The circular motion of the fuel in groove 40 causes the fuel to spread out into a thin film over the inner surface of the groove. This thin film of fuel is gradually carried away by the air stream issuing from the orifice 48 and breaks up into a finer vapor than in the conventional atomizer. The resident time of the fuel in the groove also stretches the time of the fuel delivery in a significant amount and permits the operation frequency of the fuel control valve be reduced at high engine speeds by a factor better than two thus improving the life expectancy of the solenoid in terms of the mileage.

Figure 3:
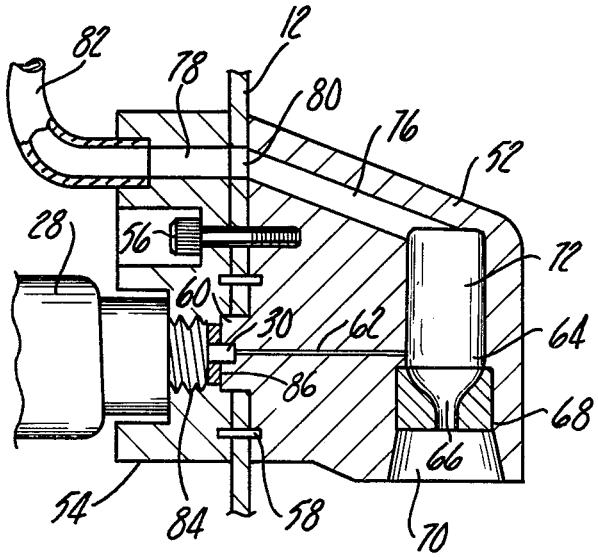
FIG. 3 is a cross sectional view of an alternate embodiment of the air assisted fuel atomizer.

An alternate embodiment of the improved air assisted fuel atomizer is illustrated in FIG. 3. An atomizer housing 52 and a bracket 54 are attached to the wall of the throttle body 12 by means of one or more fasteners illustrated as bolt 56. The alignment between atomizer housing 52 and bracket 54 with the mating apertures in the throttle body 12 may be established by one or more pins 58 as is well known in the art. Atomizer housing 52 has a boss 60 which protrudes through an aperture in the wall of the throttle body 12 into a mating cavity formed in the bracket 54. This boss may be an integral part of the atomizer as shown or may be a bushing pressed therein. Concentric with the boss 60 is a fuel passageway 62 leading from the face of the boss to a fuel swirl chamber 64 which functions in a manner similar to groove 40 illustrated and described in reference to FIG. 1. The fuel passageway 62 enters the fuel swirl chamber 64 tangential to its external surface as discussed relative to FIGS. 1 and 2. A centrally disposed orifice 66 in an orifice plate 68 mounted in the atomizer housing 52 connects fuel swirl chamber 64 with an exit port 70 having a diameter substantially larger than orifice 66. In this configuration, the upper surface of the orifice plate 68 has a generally concave parabolic configuration blending in with the mating surface of the swirl chamber as shown so that the fuel will continue to swirl along the parabolic surface as it approaches the orifice 66. The opposite end of fuel groove 62 is connected to a cylindrical chamber 72 located above the fuel swirl chamber 64. An air passageway 76 connects the cylindrical chamber 72 with a mating passageway 78 in bracket 54 through an aperture 80 in the wall of the throttle body 12. The other end of passageway 78 is connected to a conduit 82 which has its other end connected to the primary air passageway 18 of the throttle body 12 above the valve 22 the same as passageway 44 of FIG. 1. The passageway 76 enters the chamber 72 tangential to the external surfaces so that the air entering from passageway 76 is caused to swirl therein. In the alternative the air may enter the chamber 72 axially as previously discussed.

Bracket 54 has a threaded hole 84 for receiving the fuel control valve 28 so that its out port 30 is aligned with passageway 62. A gasket 86 prevents fuel leaking between the fuel control valve 28 and the boss 60.

The operation of this alternate embodiment of the air assisted atomizer is as follows. Air from above the throttle valve enters cavity 72 through passageway 76 passes through fuel swirl chamber 64 and aperture 66 and exits through output port 70. Fuel ejected from the fuel control valve 28 is entered into the fuel swirl chamber 64 through passageway 62. The relatively high velocity of the fuel entering groove 64 from the injector valve develops a thin fuel ring within the fuel swirl chamber as discussed relative to FIG. 1. Due to gravitational forces and the air flow through the fuel swirl chamber the thin film of fuel also spreads out over the parabolic surface of aperture plate 68 increasing the surface area of the formed fuel ring. The swirling fuel is then carried away by the air flow and forms a fine conical spray having fuel particles finer particles than achieved in conventional atomizers. As discussed with reference to the embodiment of FIG. 1 the residual time of the fuel in the swirl chamber stretches the time of fuel delivery in a significant amount permitting the operating frequency of the fuel control valve to be reduced at high engine speeds, thus improving not only the fuel distribution but also the life expectancy of the solenoid valve in terms of vehicle mileage. The angle of the fuel spray cone can be controlled to some extent by the air flow through the atomizer. When the air enters the chamber 72 axially the spray angle is minimum; however, when the air enters chamber 72 tangentially, the air will also swirl and the spray angle increases.

Figure 4:
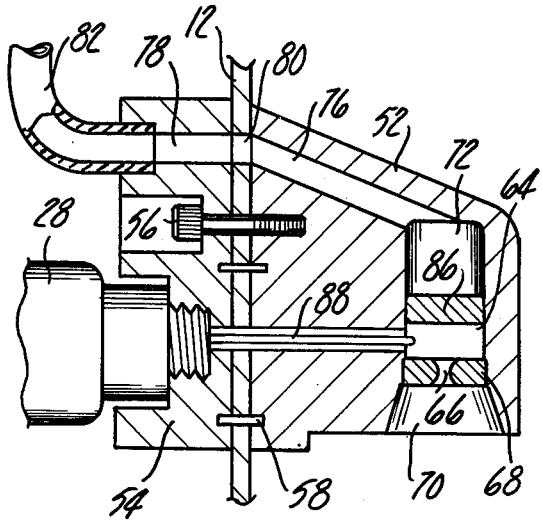
FIG. 4 is a cross sectional view of a second alternate embodiment of the air assisted fuel atomizer.

Another embodiment of the air assisted atomizer is illustrated in FIG. 4. This embodiment is similar to that illustrated in FIG. 3 without the parabolically shaped orifice plate, but includes a swirl plate 86 having a plurality of angularly disposed blades to further increase the swirling of the air issuing from cavity 72. This embodiment also shows a tube 88 connecting the output port of the fuel control valve 28 with fuel swirl chamber 64. Tube 88 has a right angle bend at its output end so that the fuel is injected into the chamber 64 tangential to its external surface. The operation of the embodiment shown in FIG. 4 is similar to that discussed relative to the embodiment illustrated in FIG. 3.

Figure 5:
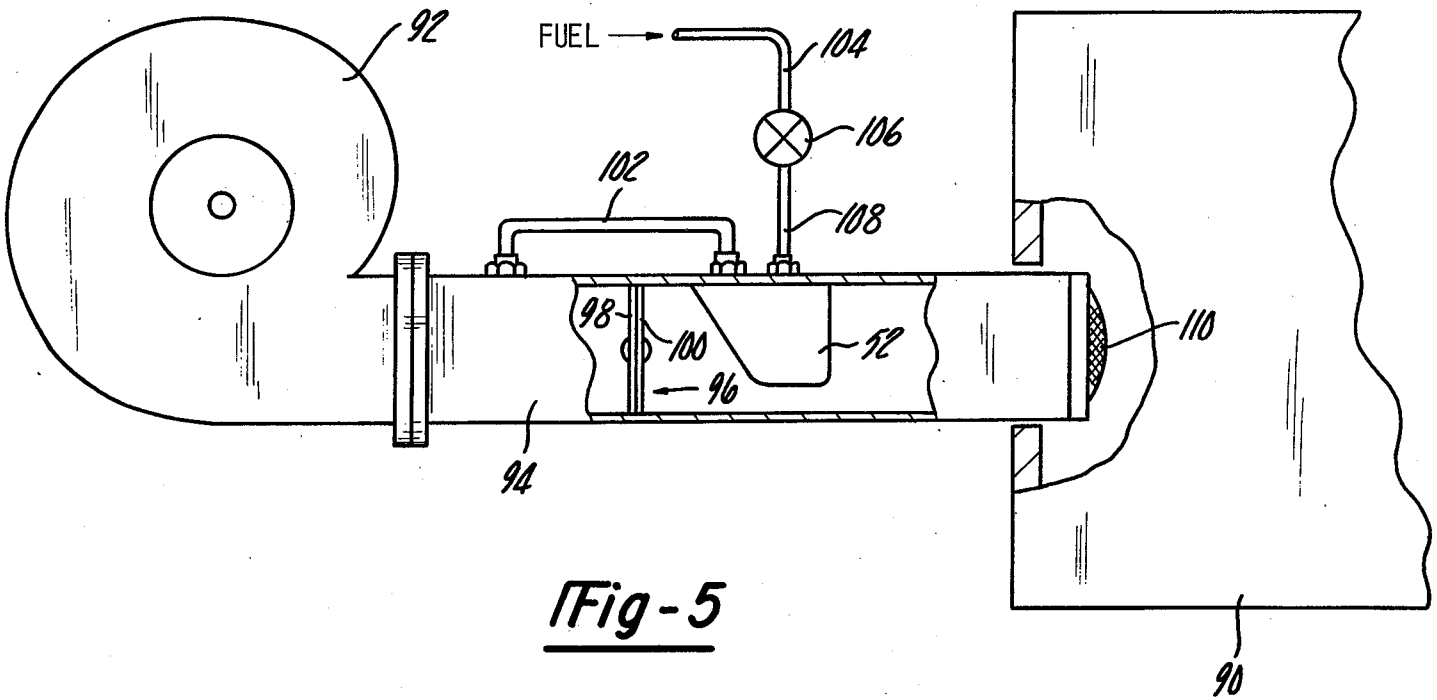
FIG. 5 illustrates the application of the air assisted atomizer to a forced air furnace.

The air assisted atomizer may also be used with other fuel consuming devices, as illustrated in FIG. 5. A forced air furnace 90 receives air from a pressurized source such as blower 92 through a conduit 94. A variable aperture 96 controls the air flow through the conduit 94. The variable aperture may be of any form such as the two concentric sectored discs 98 and 100 which may be rotated relative to each other to vary the open to occluded area.

An air assisted atomizer 52 as illustrated on FIGS. 3 and 4 is disposed in the conduit 94 downstream of the variable aperture 96. Air is supplied to the atomizer 52 by means of secondary air conduit 102 receiving pressurized air from conduit 94 upstream of the variable aperture 96. Fuel from a pressurized fuel source (not shown) is supplied to the atomizer 52 via a fuel line 104 control valve 106 and connecting fuel line 108. A flame barrier such as mesh screen 110 may be disposed at the end of conduit 94 inside the furnace 90 to prevent the flame front from traveling back into conduit 94.

The operation of the air assisted atomizer in this application is basically the same as discussed relative to FIGS. 1 through 4.

Although the improved air assisted atomizer has been illustrated and discussed with reference to specific embodiments it is not intended that the invention be limited to those embodiments illustrated and discussed herein. It is believed that one skilled in the art could conceive alternate embodiments capable of performing the same function disclosed herein without departing from the spirit of the invention.

What is claimed is:

1. A delivery system for providing an atomized air/fuel mixture to the intake manifold of an internal combustion engine comprising:

a throttle body connected to the intake manifold having a primary air passageway therethrough providing an air flow path from an external source to the intake manifold;

throttle valve means disposed in said throttle body for controlling the air flow through said primary air passageway in response to operator commands;

means for generating signals having a value indicative of the engine's fuel requirement;

fuel delivery means for delivering a quantity of fuel in response to said signals, said fuel delivery means including at least one fuel control valve having an input port receiving fuel under pressure from an external source and an output port outputting said quantity of fuel;

atomizer means disposed in said air passageway downstream of said throttle valve means, said means comprising an air chamber having a cylindrical inner surface, a secondary air passageway conducting air from said primary air passageway upstream of said throttle valve means to said air chamber tangential to said cylindrical surface, an orifice concentric with said air chamber restricting the air flow through the said air chamber, a generally circular fuel swirl chamber disposed adjacent to said orifice, connecting means connecting the output port of said fuel control valve with said fuel swirl chamber for injecting said quantity of fuel into said fuel swirl chamber tangential to the inner surface of said fuel swirl chamber to form a fuel ring therein, and an exit port conducting the air received by said air chamber and the fuel injected into said fuel swirl chamber back into said air passageway downstream of said atomizer means.

2. The delivery system of claim 1 wherein said connecting means is a fuel passageway radially offset from said fuel swirl chamber, said fuel passageway receiving said quantity of fuel output from the output port of said fuel delivery means and injecting said received quantity of fuel into said fuel swirl chamber in a direction tangential to the internal surface of said fuel swirl chamber.

3. The delivery system of claim 1 wherein said connecting means comprises a tube having one end connected to the output port of said fuel delivery means and the other end disposed in said fuel swirl chamber, said tube having a bend adjacent to said other end to inject the fuel tangential to the inner surface of said fuel swirl chamber.

4. The delivery system of claim 1 wherein said orifice has a concave parabolic surface, mating with the adjoining surface of the fuel swirl chamber.

5. The delivery system of claim 1 wherein said atomizer means further includes a swirl plate having a plurality of angularly disposed blades disposed between said air chamber and said fuel swirl chamber to cause the air exiting said air chamber to swirl.

6. In combination with an air/fuel delivery system for an internal combustion engine having:

an intake manifold directing the air fuel mixture to the individual engine cylinders;

a throttle body connected to the intake manifold having a primary air passageway therethrough providing an air path from an external source to the intake manifold;

throttle valve means disposed in said throttle body for controlling the air flow through said primary air passageway in response to operator commands;

means for generating signals having a valve indicative of the engine's fuel requirements; and fuel delivery means for delivering a quantity of fuel in response to said signals, said fuel delivery means having an input port receiving pressurized fuel from an external source and an output port outputting said quantity of fuel;

an improved air assisted fuel atomizer comprising:

an atomizer housing disposed in said throttle body downstream of said throttle valve means and concentric with said primary air passageway;

a secondary air passageway conducting air from said primary air passageway upstream of said throttle valve means to said atomizer housing;

an orifice disposed in said atomizer housing restricting the air flow through said atomizer housing;

a circular fuel swirl chamber disposed in said atomizer housing adjacent to said orifice and concentric therewith, said fuel swirl chamber having a recessed inner surface; and means connecting the output port of said fuel delivery means with said fuel swirl chamber for injecting said quantity of fuel into said fuel swirl chamber tangential to its inner surface to form a fuel ring therein.

7. The combination of claim 6 wherein said orifice is disposed between said circular fuel swirl chamber and said secondary air passageway.

8. The combination of claim 7 wherein said atomizer housing further includes an air chamber having a cylindrical inner surface concentric with said orifice receiving air from said secondary air passageway tangential to the cylindrical surface.

9. The combination of claim 8 wherein said atomizer means is formed integral with said throttle body said secondary air passageway is an air passageway disposed in said throttle body paralleling said primary air passageway and having an input port connecting to the primary air passageway above said throttle valve means.

10. The combination of claim 9 wherein said connecting means is a fuel passageway radially offset from the axis said fuel swirl chamber, said fuel passageway receiving said quantity of fuel output from the output port of said fuel delivery means and injecting said received fuel into said fuel swirl chamber in a direction tangential to the internal surface of said fuel swirl chamber.

11. The combination of claim 9 wherein said connecting means comprises a tube having one end connected to the output port of said fuel delivery means and an exit port disposed in said fuel swirl chamber said tube having a bend adjacent to said exit port to inject the fuel tangential to the inner surface of said fuel swirl chamber.

12. The combination of claim 9 wherein said fuel swirl chamber is a recessed cylindrical groove.

13. The air assisted fuel atomizer of claim 6 wherein said fuel swirl chamber is disposed between said secondary air passageway and said orifice.

14. The air assisted fuel atomizer of claim 13 wherein said fuel swirl chamber is a recessed cylindrical groove.

15. The air assisted fuel atomizer of claim 13 wherein said orifice has a concave parabolic surface adjoining with the mating surface of the fuel swirl chamber.

16. The combination of claim 13 wherein said atomizer further includes an air chamber having cylindrical inner surface concentric with said orifice receiving the air from the secondary air passageway tangential to said cylindrical surface.

17. The combination of claim 6 wherein said atomizer housing is formed integral with said throttle body said secondary air passageway in an air passageway disposed in said throttle paralleling said primary air passageway and having an input port connecting to said primary air passageway above said throttle valve means.

18. The combination of claim 6 wherein said connecting means comprises a tube having one end connected to the output port of said fuel delivery means and the other end disposed in said fuel swirl chamber, said tube having a bend adjacent to said other end to inject the fuel tangential to the inner surface of said fuel swirl chamber.

19. The combination of claim 18 wherein said air assisted fuel atomizer further includes a swirl plate having a plurality of angularly disposed blades disposed between said secondary air passageway and said fuel groove to cause the air exiting said air chamber to swirl.

20. An improved air assisted fuel atomizer for a liquid fuel consuming device comprising:

a conduit having a pressure differential thereacross for conducting an air flow to the device said conduit including throttle means for controlling the quantity of air flowing therethrough;

an atomizer housing centrally disposed in said conduit downstream from said throttle means;

a secondary air passageway having one end receiving air at a pressure greater than the pressure at the end of said conduit connected to the device for conducting air to said atomizer housing;

an orifice disposed in said housing to restrict the air flow received from said secondary air passageway through said air chamber;

a fuel swirl chamber disposed in said housing adjacent to said orifice and concentric therewith;

fuel delivery means for supplying a predetermined quantity of fuel under pressure at an output port; and a fuel passageway connecting the output port of said fuel delivery means with said fuel swirl chamber, said fuel passageway injecting said fuel into said fuel swirl chamber tangential to said inner surface thereof to form a fuel ring therein.

21. The air assisted atomizer of claim 20 wherein said fuel swirl chamber is disposed downstream of said orifice.

22. The air assisted atomizer of claim 21 wherein said fuel swirl chamber is a recessed cylindrical groove.

23. The air assisted atomizer of claim 21 wherein said fuel swirl chamber is disposed between said secondary air passageway and aid orifice.

24. The air assisted atomizer of claim 23 wherein said orifice has a concave parabolic surface mating with the adjoining surface of said fuel swirl chamber.

25. The air assisted atomizer of claim 21 further including a swirl plate having a plurality of angularly disposed blades disposed between said fuel swirl chamber and secondary air passageway to cause the air exiting the air chamber to swirl.

* * * * *